US005300854A

United States Patent [19]

Kweon

[11] Patent Number: 5,300,854

[45] Date of Patent: Apr. 5, 1994

[54] ELECTRODE STRUCTURE FOR AN ELECTRON GUN FOR A CATHODE RAY TUBE

[75] Inventor: Yong-geol Kweon, Seoul, Rep. of Korea

[73] Assignee: Samsung Electron Devices Co., Ltd., Kyunggi, Rep. of Korea

[21] Appl. No.: 809,434

[22] Filed: Dec. 18, 1991

[30] Foreign Application Priority Data

Dec. 18, 1990 [KR] Rep. of Korea ..... 90-20986

[51] Int. Cl.[5] ..... H01J 29/50; H01J 29/51

[52] U.S. Cl. ..... 313/414; 313/412; 313/413

[58] Field of Search ..... 313/414, 409, 412, 413, 313/439

[56] References Cited

U.S. PATENT DOCUMENTS 4,370,592 1/1983 Hughes et al. .

FOREIGN PATENT DOCUMENTS 0108153 8/1980 Japan ..... 313/414

*Primary Examiner*—Donald J. Yusko
*Assistant Examiner*—Nimesh Patel
*Attorney, Agent, or Firm*—Leydig, Voit & Mayer

[57] ABSTRACT

An electron gun for a cathode ray tube includes common large-aperture electron beam passing holes which are formed by recessing the portion except the rims on the outgoing side plane of a focus electrode and the incoming side plane of a final accelerating electrode, for expanding an electric field. Three independent small-aperture electron beam passing holes are formed at the recessed position by a predetermined depth from the rims. The ratio of the horizontal diameter to the vertical diameter of the central electron beam passing hole among the three independent small-aperture electron beam passing holes of the focus electrode is smaller than those of the outer independent small-aperture electron beam passing holes. Accordingly, the influence of the spherical aberration to the electron beam which passes through the main lens is reduced, so that the quality of the picture reproduced on the screen is improved.

1 Claim, 3 Drawing Sheets

ELECTRODE STRUCTURE FOR AN ELECTRON GUN FOR A CATHODE RAY TUBE

FIELD OF THE INVENTION

The present invention relates to an electron gun for a cathode ray tube, and more particularly to an electron gun having an improved electric field expanding type focusing lens.

BACKGROUND OF THE INVENTION

As shown in FIG. 1, a general electron gun for a cathode ray tube is structured in such a way that a cathode 2, a control electrode 3, and a screen electrode 4 which together constitute a triode for generating beams, and a focus electrode 5 and a final accelerating electrode 6 which focus and accelerate the electron beam by forming a main lens system wherein the focus electrode 5 and the final accelerating electrode 6 are sequentially arranged in the direction of the electron beam's path. In the electron gun 1 having the above constitution, a thermal electron emitted from the cathode 2 is formed as a beam by being previously focused and accelerated through a prefocus lens 5A positioned between the screen electrode 4 and the focus electrode 5, and this electron beam arrives on the phosphor screen by being finally focused and accelerated through the main lens 5B positioned between the focus electrode 5 and the final accelerating electrode 6. Such an electron beam is continuously projected onto the phosphor surface, in which the beam sequentially scans the desired positions by the deflection of the magnetic field, reproducing a completed image on the phosphor surface. To obtain a sharp image having a high resolution on the phosphor surface, the diameter of the beam spot formed on the phosphor surface is as small as possible, and around the beam, the spot's halo due to the influence of the spherical aberration should be minimal.

The aforementioned conventional electron gun has a very strong main lens because of its structural characteristics. Accordingly, the intensity of the beam spot formed in the phosphor surface and that of the spot halo around the core of the beam spot are relatively high due to the strong influence of the spherical aberration to the electron beam passing through the main lens, so that a high quality picture is unattainable.

To solve the problem of deteriorating the beam spot's characteristics due to spherical aberration, a larger-aperture main lens should be provided in the electron gun. To accomplish this in the conventional electron gun, the electron beam passing holes of the focus electrode and those of the final accelerating electrode have maximum-sized diameters. But, since the size of the electron gun is limited by the diameter of the funnel's neck (where an electron gun is disposed), the diameter of the beam passing holes are limited.

That is, the electron beam passing holes are formed in an in-line manner in the focus electrode and the final accelerating electrode, which are inserted into the neck of a cathode ray tube, so that each diameter of the electron beam passing holes is smaller than the distance between the centers of two adjacent electron beam passing holes. Also, if the distance between the centers is enlarged so that it is larger than the original designed value, the convergence degree of the outer electron beam of the electron gun becomes larger, thereby deteriorating the picture quality.

The U.S. Pat. No. 4,370,592 discloses a method to solve these problems. As shown in FIG. 2, the u-shaped portions (hereinafter referred to as rims 7' and 8') are recessed by a predetermined depth in the outgoing side 7A of the focus electrode 7 and the incoming side 8A of the final accelerating electrode 8, thereby forming large-aperture electron beam passing holes 7H and 8H through which R, G, and B electron beams pass, and R, G, and B independent small-aperture electron beam passing holes 7H' and 8' on the bottom of the large-aperture electron beam passing holes 7H and 8H.

In such an electron gun, since the large-aperture electron beam passing holes 7H and 8H are asymmetric, the electron beam having passed through the central indepentent small-aperture electron beam passing hole and the electron beams having passed through the outer independent small-aperture electron beam passing holes are differently affected by the vertical and horizontal focusing forces which influence the formation of the electron beam spot formed on the phosphor surface.

That is, as shown in FIG. 2B, the outer electron beams RB and BB passing through the large-aperture electron beam passing hole of the focus electrode 7 or the final accelerating electrode 8, pass near the rims 7' and 8' maintaining a low voltage or a high voltage in the horizontal direction; and the central electron beam GB passing through the central electron beam passing hole passes a relatively long distance from the rims 7' and 8'. Accordingly, the outer electron beams RB and BB are relatively strongly focused in the horizontal direction and the central electron beam GB is relatively weakly focused. Also, the distance between outer electron beams RB and BB and the rims 7' and 8' in the vertical direction are almost equal to that in the horizontal direction. Accordingly outer electron beams are affected by the strength of the focusing force in the vertical direction which is similar to that in the horizontal direction.

However, since the distance between the central electron beam GB and the rims 7' and 8' in the vertical and horizontal directions are different and the distance to the rim in the horizontal direction is relatively large, the central electron beam is affected by a strong electric field in the vertical direction. Consequently, the central electron beam is affected by a relatively stronger focusing force vertically than the horizontally.

Accordingly, the outer electron beams RB and BB and the central electron beam GB having passed through the main lens have cross-sections of different formations, respectively, so that an evenly shaped beam spot formed on the phosphor surface cannot be obtained.

SUMMARY OF THE INVENTION

It is an object of the present invention to solve the aforementioned problems and to provide an electron gun for a cathode ray tube which is improved to make the formation of the beam spot on the phosphor surface by the central electron beam be similar to that by the outer electron beam, thereby obtaining a high quality picture.

To achieve this object, the present invention comprises:

an electron beam generating part containing a cathode, a control electrode, and a screen electrode for generating an electron beam; and a main lens including a focus electrode and an anode electrode for accelerating and focusing the electron beam, wherein large-aperture electron beam passing holes, through which R, G, and B electron beams commonly pass, are provided by forming a rim at each of the edges of electron beam outgoing side plane of the focus electrode and electron beam incoming side plane of the anode electrode, and three independent small-aperture electron beam passing holes are formed on the bottom of the large-aperture electron beam passing holes, and when the vertical and horizontal diameter of the central electron beam passing hole of the three small-aperture electron beam passing holes of the focus electrode are DV and DH and the vertical and horizontal diameters of the outer electron beam passing holes are DV' and DH', the following expression is satisfied:

$$\frac{DH'}{DV'} > \frac{DH}{DV} \geqq 1$$

BRIEF DESCRIPTION OF THE DRAWINGS

The above object and other advantages of the present invention will become more apparent by describing the preferred embodiment of the present invention with reference to the attached drawings, in which.

DETAILED DESCRIPTION OF THE INVENTION

Figure 1:
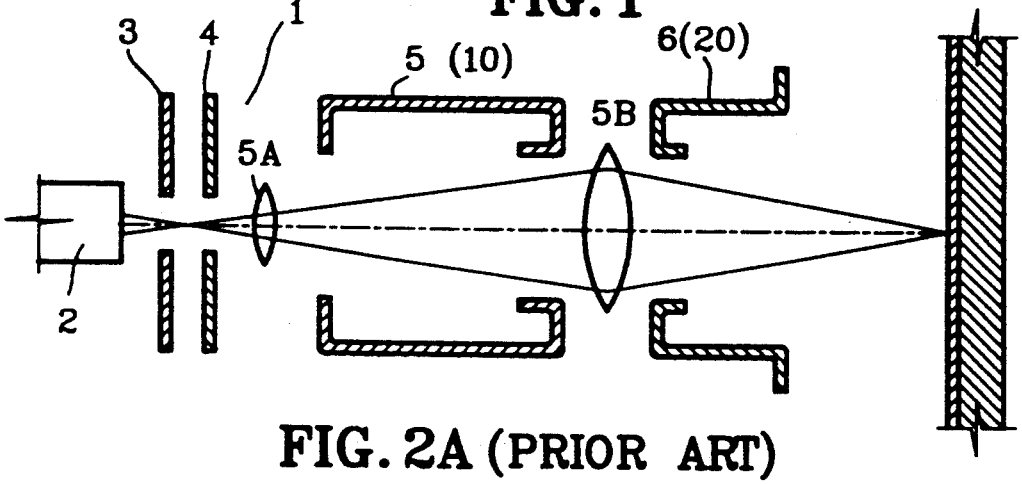
FIG. 1 is a cross-sectional diagram of a general electron gun for a cathode ray tube.
Figure 2A:
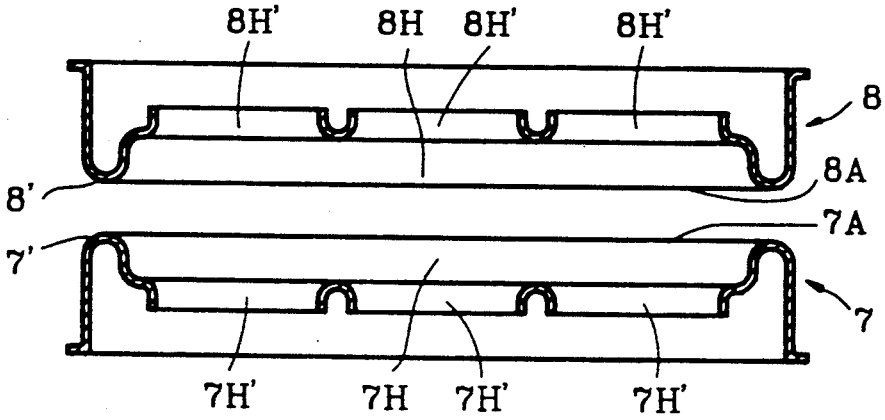
FIG. 2A (PRIOR ART)
FIG. 2A is an extracted plan cross-sectional view of the conventional focus electrode and final accelerating electrode.
Figure 2B:
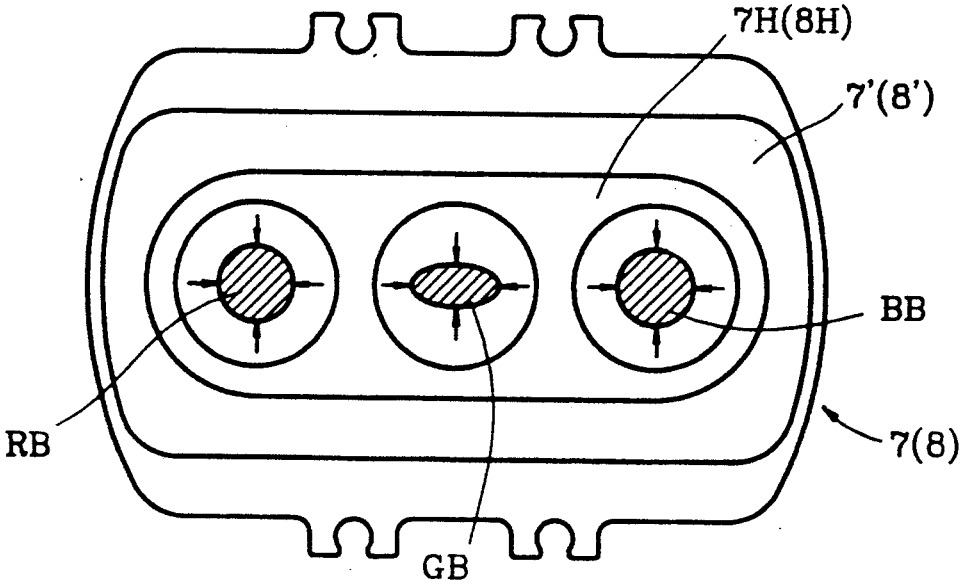
FIG. 2B (PRIOR ART)
FIG. 2B is a front view of the conventional focus electrode shown in FIG. 2A.
Figure 3:
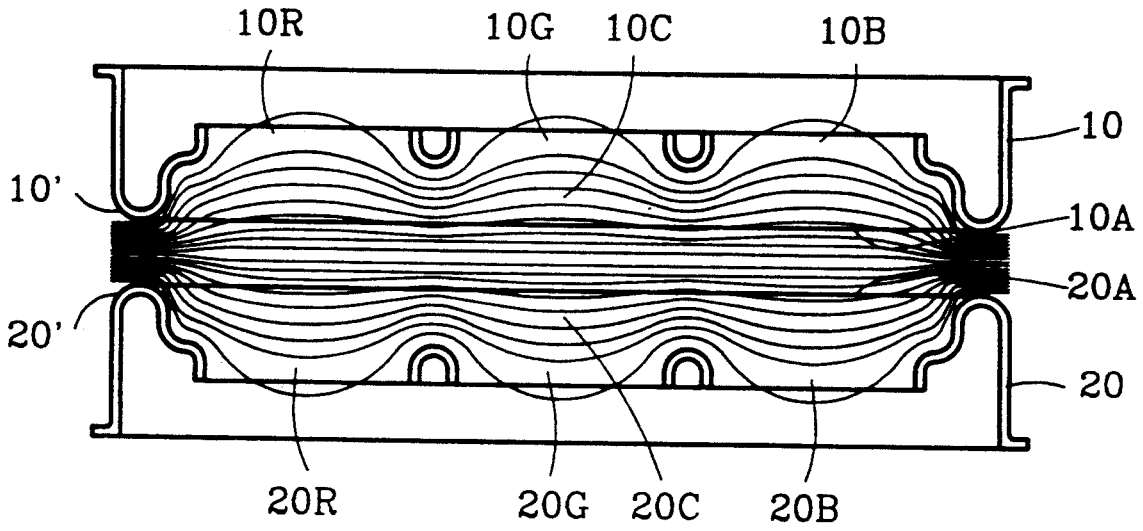
FIG. 3 is a plan cross-sectional view of a focus electrode and a final accelerating electrode according to the present invention, which shows the distribution of the equipotential lines.
Figure 4:
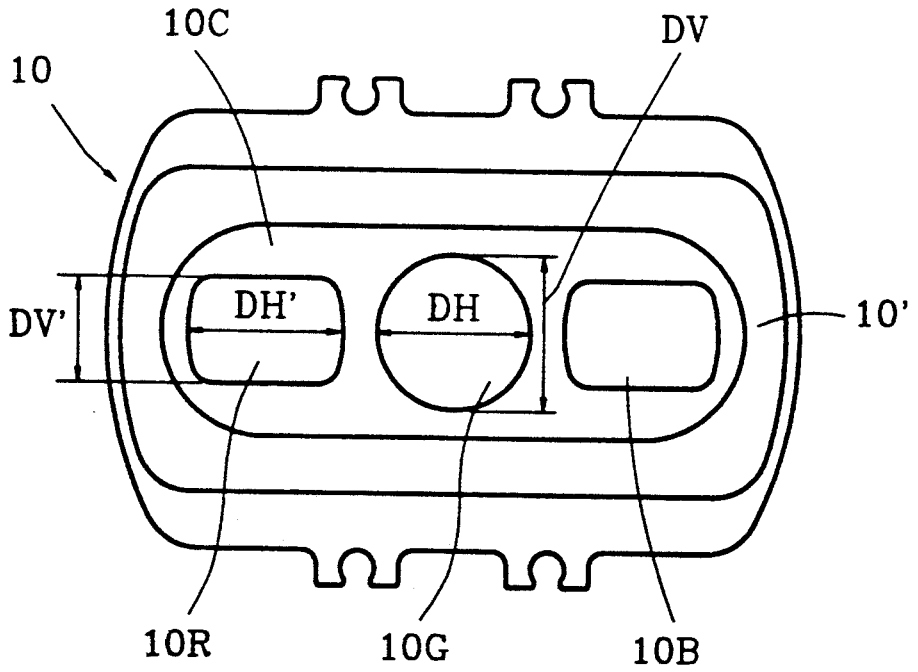
FIG. 4 is a front view of a focus electrode shown in FIG. 3.

As shown in FIG. 1, a cathode 2, a control electrode 3, and a screen electrode 4 together constitute a triode for generating electron beams, and a focus electrode 10 and a final accelerating electrode 20 together constitute a major lens system for focusing and accelerating the generated electron beam. These elements are disposed in the cited order in the preceding direction of the electron beam. As shown in FIG. 3, Large-Aperture electron beam passing holes 10C and 20C are provided by forming rims 10' and 20' at each edge of the electron beam outgoing side plane 10A of the focus electrode 10 and the electron beam incoming side plane 20A of the final accelerating electrode 20, both electrodes constituting the main lens, and respective three independent small-aperture electron beam passing holes 10R, 10G, 10B, 20R, 20G and 20B are formed on the bottoms of the large-aperture electron beam passing holes 10*c* and 20*c*. The central electron beam passing hole 10G among the three independent small-aperture electron beam passing holes of the focus electrode 10 is formed as shown in FIG. 4. When the vertical and horizontal diameters of the central independent small-aperture electron beam passing hole 10G of the focus electrode 10 are DV and DH and the vertical and horizontal diameters of the outer independent small-aperture electron beam passing holes 10R and 10B of the focus electrode 10 are DV' and DH', respectively, those diameters are determined according to the characteristics of the present invention by the following expression:

$$\frac{DH'}{DV'} > \frac{DH}{DV} \geqq 1$$

The operation of the present electron gun for a cathode ray tube having the above-mentioned constitution is described as follows.

When the electrodes constituting the main lens, i.e., the focus electrode 10 and the final accelerating electrode 20, are supplied with voltages of approximately 7 kV and 25 kV, respectively, the equipotential lines as shown in FIG. 3 are distributed in such a way that an electric field formed by a low potential of approximately 7 kV is distributed as being nearer to the independent small-aperture electron beam passing holes 10R, 10G, and 10B, and a rim 10', of the focus electrode 10 while an electric field formed by a potential of approximately 25 kV is distributed as being nearer to the independent small-aperture electron beam passing holes 20R, 20G, and 20B, and a rim 20' of the final accelerating electrode 20. Such electric field of the a main lens extends due to the rim, through which the self-correcting capability with respect to the spherical aberration is obtained. Accordingly, each of R, G, and B electron beams which pass through the main lens formed between the focus electrode 10 and the final accelerating electrode 20 is affected by a small spherical aberration by the extended electric field.

The above-mentioned self-correction of the spherical aberration will be separated into when the electron beam passes through the large-aperture electron beam passing holes 10C and 20C, and when the electron beam passes through the independent small-aperture electron beam passing holes 10R, 10G, 10B, 20R, 20G, and 20B.

Figure 5A:
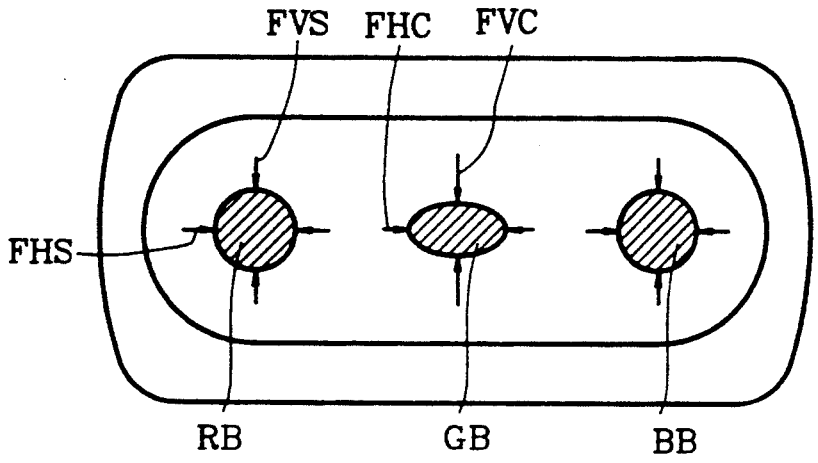
FIGS. 5A and 5B show the cross-sectional shapes of the electron beam when the electron beam passes through the large-aperture electron beam passing hole of the focus electrode and the small-aperture electron beam passing hole shown in FIG. 3, respectively.

As shown in FIG. 5A, a central electron beam GB, e.g., the green electron beam, among three electron beams passing through the common electron beam passing holes 10C and 20C, is disposed far from the rims 10' and 20' horizontally and in the vertical direction, relatively near rims 10' and 20'. The electron beam of the green signal is vertically affected by a strong focusing force FVC and by a relatively weak focusing force FHC in the horizontal direction, thereby having a sectional shape which is horizontally extended. Since electron beams RB and BB of either side, e.g., the red and blue electron beams, are disposed equidistant from the rims 10' and 20' in the horizontal and vertical directions, the two beams are nearly equally affected by vertical and horizontal focusing forces FVS and FHS, thereby having a cross sectional shape of a substantially normal circle.

Figure 5B:
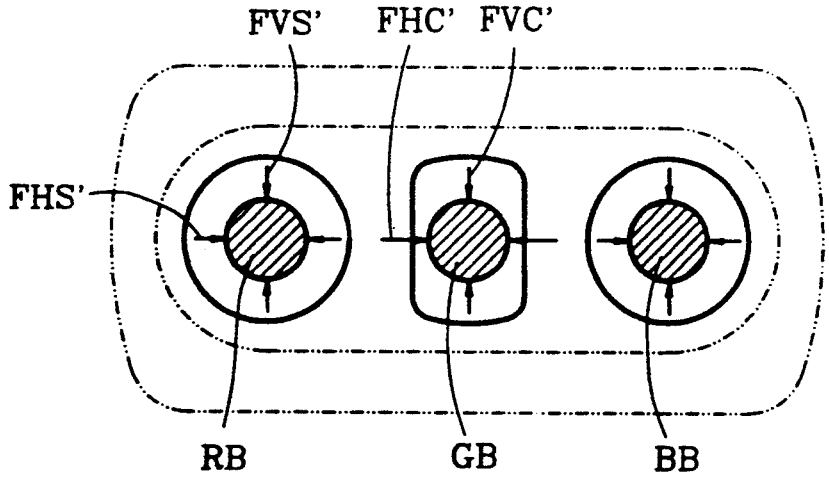

The three electron beams pass through the independent small-aperture electron beam passing holes 10R, 10G, and 10B. When the ratio (DH/DV) of the horizontal diameter to the vertical diameter of the central independent small-aperture electron beam passing hole 10G is equal to 1, it becomes a circle, and since the ratio (DH'/DV') of the horizontal diameter to the vertical diameter of the outer electron beam passing holes 10R and 10B, is greater than 1 and also greater than the ratio DH/DV, the cross-sectional shape of the central electron beam GB is a circle by being affected by the same focusing forces FVC' and FHC' in the vertical and horizontal directions as shown in FIG. 5B.

Also, since the central electron beam GB passes through the large-aperture electron beam passing hole 10C, and the horizontally lengthened central electron beam GB also passes through the central independent small-aperture electron beam passing hole 10G, it is affected by a focusing force which does not generate a change in the cross-sectional shape, i.e., which generates a circle, so that a circular cross-sectional formation is finally obtained.

On the other hand, when the outer electron beams RB and BB pass through the independent small-aperture electron beam passing holes 10R and 10B, they are affected by a strong focusing force FVS' in the vertical direction and a weak focusing force FHS' in the horizontal direction, thereby obtaining a horizontally lengthened elliptic sectional formation. Also, when they pass through the large-aperture electron beam passing hole 10C, there is not generated a change in the cross-sectional shape, so that they finally have an elliptic sectional shape which is horizontally lengthened as the central electron beam.

As described above, the electron gun of the present invention is constituted to improve the distortion of the electron beam, i.e., the spherical aberration, due to the nonuniform electric field of the main lens. Moreover, since the sectional formations of beams are as similar as possible, a high quality picture can be achieved.

What is claimed is:

1. An electron gun for a color cathode ray tube comprising:

an electron beam generating part including a cathode, a control electrode, and a screen electrode for generating an electron beam having first, second and third components; and a main lens including a focus electrode and an acceleration electrode for accelerating and focusing the electron beam, wherein a recess, through which the first, second and third components commonly pass, is provided by forming a rim at each of the edges of an electron beam outgoing side plane of the focus electrode and an incoming side plane of the acceleration electrode, and three independent small-aperture electron beam passing holes are formed on the bottom of the recess in the focus electrode and when the vertical and horizontal diameters of the central electron beam passing hole of said three small-aperture electron beam passing holes of said focus electrode are DV and DH, respectively, and the vertical and horizontal diameters of the flanking electron beam passing holes are DV' and DH', respectively, the following expression is satisfied:

$$\frac{DH'}{DV'} > \frac{DH}{DV} \geqq 1.$$

* * * * *